US009515387B2

(12) United States Patent
Hung et al.

(10) Patent No.: US 9,515,387 B2
(45) Date of Patent: Dec. 6, 2016

(54) MULTI-INPUT MULTI-OUTPUT ANTENNA WITH ELECTROMAGNETIC BAND-GAP STRUCTURE

(75) Inventors: Kuo-Fong Hung, Changhua (TW); Ho-Chung Chen, Taipei (TW); Mao-Lin Wu, Jhubei (TW); Chien-Chih Lee, Keelung (TW)

(73) Assignee: MEDIATEK INC., Hsin-Chu (TW)

( * ) Notice: Subject to any disclaimer, the term of this patent is extended or adjusted under 35 U.S.C. 154(b) by 613 days.

(21) Appl. No.: 13/588,496

(22) Filed: Aug. 17, 2012

(65) Prior Publication Data

US 2014/0049437 A1 Feb. 20, 2014

(51) Int. Cl.
*H01Q 21/28* (2006.01)
*H01Q 15/00* (2006.01)
*H01Q 1/52* (2006.01)

(52) U.S. Cl.
CPC ..... *H01Q 15/006* (2013.01); *H01Q 1/521* (2013.01); *H01Q 21/28* (2013.01)

(58) Field of Classification Search
CPC ..... H01Q 21/28
USPC ..... 343/841
See application file for complete search history.

(56) References Cited

U.S. PATENT DOCUMENTS

2009/0323587 A1* 12/2009 Trachewsky ..... H04L 27/0012 370/328
2010/0060534 A1 3/2010 Oodachi
2011/0026624 A1* 2/2011 Gummalla ..... H01Q 1/243 375/260
2011/0134010 A1* 6/2011 Toyao ..... H01P 1/2005 343/844
2011/0210906 A1* 9/2011 Maruyama ..... H01Q 15/14 343/912

* cited by examiner

*Primary Examiner* — Sue A Purvis
*Assistant Examiner* — Andrea Lindgren Baltzell
(74) *Attorney, Agent, or Firm* — McClure, Qualey & Rodack, LLP

(57) ABSTRACT

A MIMO (Multi-Input Multi-Output) antenna includes a system ground plane, an antenna ground plane, an EBG (Electromagnetic Band-Gap) structure, a first antenna element, and a second antenna element. The antenna ground plane overlaps a first portion of the system ground plane. The EBG structure is formed on a second portion of the system ground plane. The first antenna element and the second antenna element are both disposed in proximity to the EBG structure, but substantially extend in different directions.

19 Claims, 9 Drawing Sheets

MULTI-INPUT MULTI-OUTPUT ANTENNA WITH ELECTROMAGNETIC BAND-GAP STRUCTURE

BACKGROUND OF THE INVENTION

Field of the Invention

The disclosure generally relates to a MIMO (Multi-Input Multi-Output) antenna, and more particularly, relates to a MIMO antenna with an EBG (Electromagnetic Band-Gap) structure.

Description of the Related Art

As people demand more and more transmission of digital data, relative communication standards are supporting higher and higher data transmission rates. For example, IEEE 802.11n can support MIMO technology to increase transmission rates. The relative communication standards, such as LTE (Long Term Evolution) and IEEE 802.11ad, also support MIMO operations. As a matter of fact, it is a future trend to use multiple antennas in a mobile device. However, since multiple antennas are disposed in a limited space of a mobile device, the isolation between these antennas should be taken into consideration by a designer.

Traditionally, the method for improving isolation and for reducing mutual coupling between MIMO antennas is to dispose an isolation element between two adjacent antennas, wherein the resonant frequency of the isolation element is approximately equal to that of the antennas such that the mutual coupling between the antennas is rejected. The drawback of the method is low antenna efficiency and bad radiation performance.

BRIEF SUMMARY OF THE INVENTION

In one exemplary embodiment, the disclosure is directed to a MIMO Multi-Input Multi-Output) antenna, comprising: a system ground plane; an antenna ground plane, overlapping a first portion of the system ground plane; an EBG (Electromagnetic Band-Gap) structure, formed on a second portion of the system ground plane; a first antenna element, disposed in proximity to the EBG structure, and substantially extending in a first direction; and a second antenna element, disposed in proximity to the EBG structure, and substantially extending in a second direction different from the first direction.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1A:
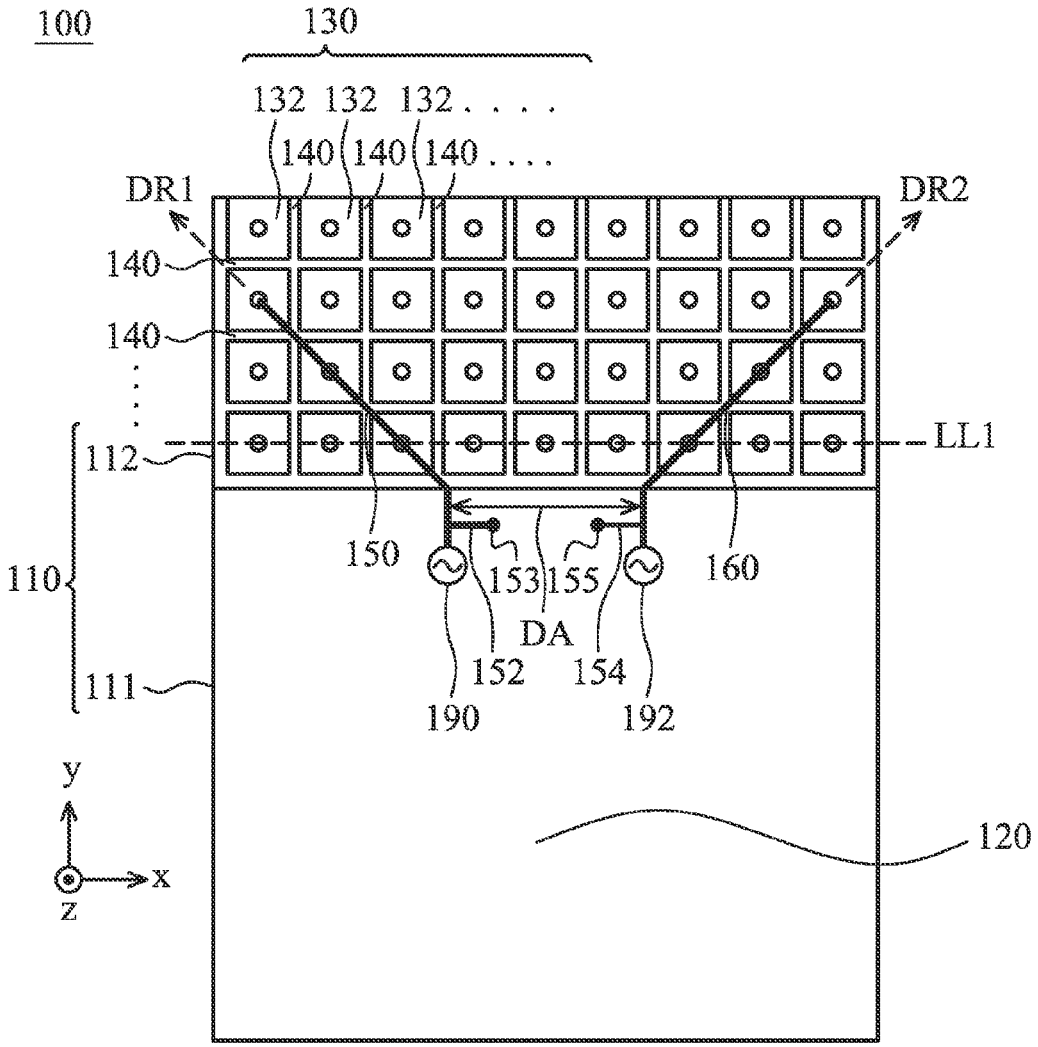
FIG. 1A is a top-view diagram for illustrating a MIMO (Multi-Input Multi-Output) antenna according to a first embodiment of the invention.
Figure 1B:
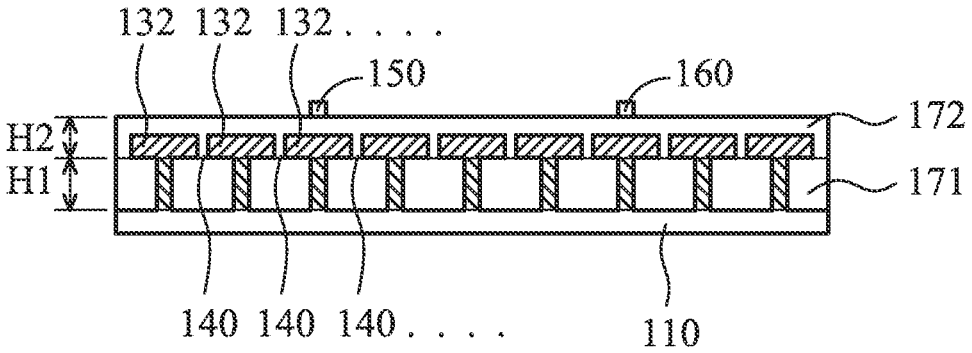
FIG. 1B is a cross-section diagram for illustrating a MIMO antenna along a straight line according to the first embodiment of the invention.

FIG. 1A is a top-view diagram for illustrating a MIMO (Multi-Input Multi-Output) antenna 100 according to a first embodiment of the invention. FIG. 1B is a cross-section diagram for illustrating the MIMO antenna 100 along a dashed line LL1 according to the first embodiment of the invention. As shown in FIGS. 1A and 1B, the MIMO antenna 100 comprises a system ground plane 110, an antenna ground plane 120, an EBG (Electromagnetic Band-Gap) structure 130, a first antenna element 150, and a second antenna element 160. The foregoing components may be made of metal, such as silver or copper. The first antenna element 150 and the second antenna element 160 may be excited by a first signal source 190 and a second signal source 192, respectively.

The system ground plane 110 comprises a first portion 111 and a second portion 112. The antenna ground plane 120 is arranged above the system ground plane 110, and overlaps the first portion 111 of the system ground plane 110. The EBG structure 130 is formed on the second portion 112 of the system ground plane 110. In some embodiments, the total height of the EBG structure 130 on the system ground plane 110 is approximately equal to the distance between the antenna ground plane 120 and the system ground plane 110. The first antenna element 150 and the second antenna element 160 may be monopole antennas. The first antenna element 150 is disposed above and in proximity to the EBG structure 130, and substantially extends in a first direction DR1. The second antenna element 160 is disposed above and in proximity to the EBG structure 130, and substantially extends in a second direction DR2, which is different from the first direction DR1. The distance DA between the signal sources 190 and 192 is smaller than 0.5 wavelength of a central operation frequency at which the first antenna element 150 and the second antenna element 160 operate. In a preferred embodiment, the first direction DR1 is substantially perpendicular to the second direction DR2. That is, the first antenna element 150 and the second antenna element 160 are substantially orthogonal to each other such that the isolation therebetween is effectively improved.

The first antenna element 150 and the second antenna element 160 may further comprise matching stubs 152 and 154, respectively. The matching stubs 152 and 154 are configured to fine tune the matching impedance of the MIMO antenna 100. In an embodiment, one end of the matching stub 152 is electrically coupled through a shorting via 153 down to the antenna ground plane 120, and one end of the matching stub 154 is electrically coupled through a shorting via 155 down to the antenna ground plane 120. In another embodiment, the foregoing ends of the matching stub 152 and 154 are open ends. Note that the matching stubs 152 and 154 are optional, and may be removed from the MIMO antenna 100 in other embodiments.

As shown in FIG. 1B, the MIMO antenna 100 may further comprise a first dielectric material 171 and a second dielectric material 172. The first dielectric material 171 is formed on the system ground plane 110, wherein the antenna ground plane 120 is disposed on the first dielectric material 171, and the EBG structure 130 is formed in the first dielectric material 171. In a preferred embodiment, the height H1 of the first dielectric material 171 is smaller than 0.1 wavelength of the central operation frequency. The second dielectric material 172 is formed on the EBG structure 130 and the antenna ground plane 120, wherein the first antenna element 150 and the second antenna element 160 are disposed on the second dielectric material 172. Similarly, the height H2 of the second dielectric material 172 is smaller than 0.1 wavelength of the central operation frequency. The dielectric constant of the first dielectric material 171 may be different from that of the second dielectric material 172. In a preferred embodiment, the total height (about the sum of H1 and H2) of the MIMO antenna 100 is smaller than 0.125 wavelength of the central operation frequency.

Figure 1C:
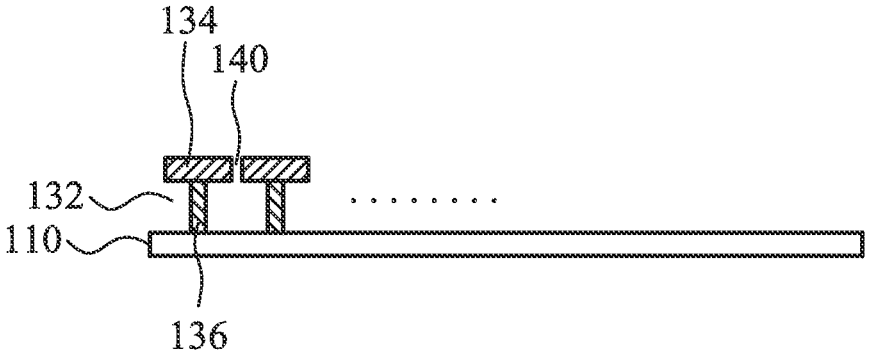
FIG. 1C is a diagram for illustrating EBG (Electromagnetic Band-Gap) cells in detail according to an embodiment of the invention.

The EBG structure 130 is different from a PEC (Perfect Electrical Conductor) with a reflection phase difference of −180 degrees, and also different from a PMC (Perfect Magnetic Conductor) with a reflection phase difference of 0 degrees. Generally, the EBG structure 130 can provide a reflection phase difference substantially from 45 degrees to 135 degrees. The periodical EBG structure 130 with the unique reflection phase difference is configured to improve antenna gain and antenna efficiency. As shown in FIGS. 1A and 1B, the EBG structure 130 comprises a plurality of EBG cells 132, and each EBG cell 132 substantially has a mushroom shape. The EBG cells 132 are separated by a plurality of partition gaps 140. In the embodiment, some of the partition gaps 140 are arranged in an X-direction (horizontal direction), and the other partition gaps 140 are arranged in a Y-direction (vertical direction). A width of each partition gap 140 may be adjusted according to the desired frequency bands. FIG. 1C is a diagram for illustrating the EBG cells 132 in detail according to an embodiment of the invention. As shown in FIG. 1C, each EBG cell 132 comprises a patch 134 and a cell via 136, wherein the patch 134 is electrically coupled through the cell via 136 down to the system ground plane 110. In a preferred embodiment, each patch 134 has a square shape, and each cell via 136 has a cylinder shape with a radius much smaller than the length of the patch 134. Note that the invention is not limited to the above. In other embodiments, the EBG cells 132 may have different shapes (e.g., circular mushroom shapes) and form other kinds of periodical structures.

Figure 2:
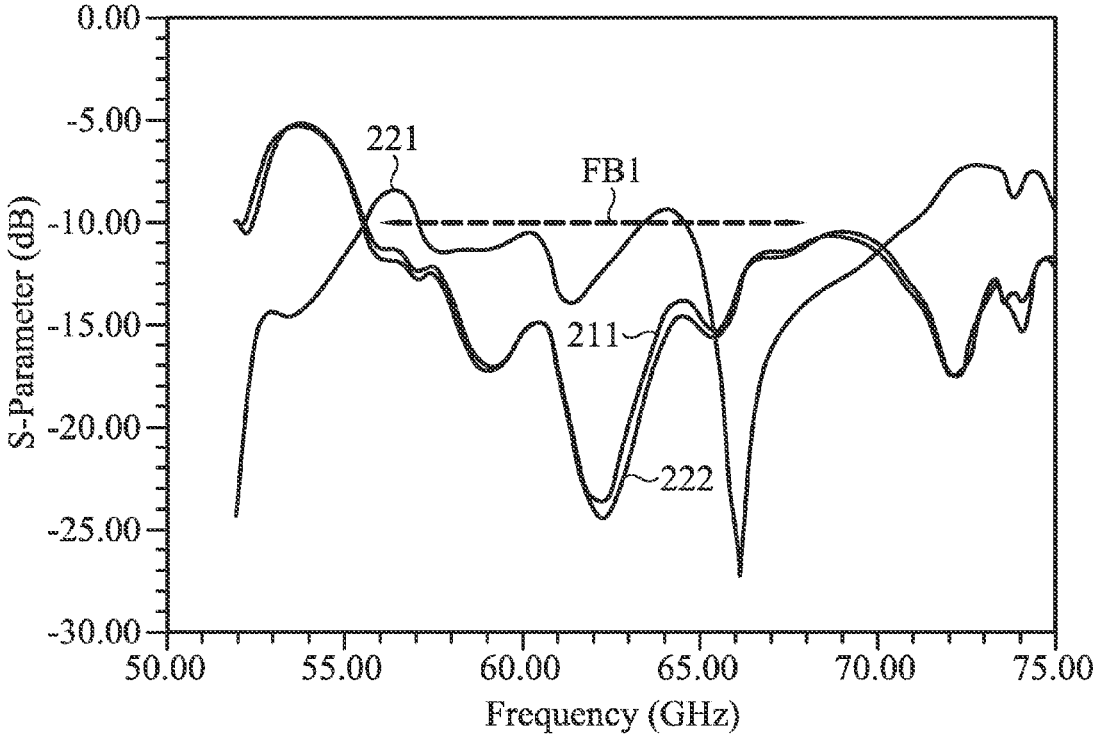
FIG. 2 is a diagram for illustrating S parameters of a MIMO antenna according to the first embodiment of the invention.

FIG. 2 is a diagram for illustrating S parameters of the MIMO antenna 100 according to the first embodiment of the invention. The horizontal axis represents S parameters (dB), and the horizontal axis represents operation frequency (GHz). As shown in FIG. 2, the reflection coefficient (S11) curve 211 of the first antenna element 150 is almost identical to the reflection coefficient (S22) curve 222 of the second antenna element 160. In a preferred embodiment, the first antenna element 150 and the second antenna element 160 cover a band FB1, which is approximately from 57 GHz to 66 GHz. Note that the isolation (S21) curve 221, which represents the isolation between the first antenna element 150 and the second antenna element 160, is substantially lower than −10 dB in the band FB1.

Figure 3:
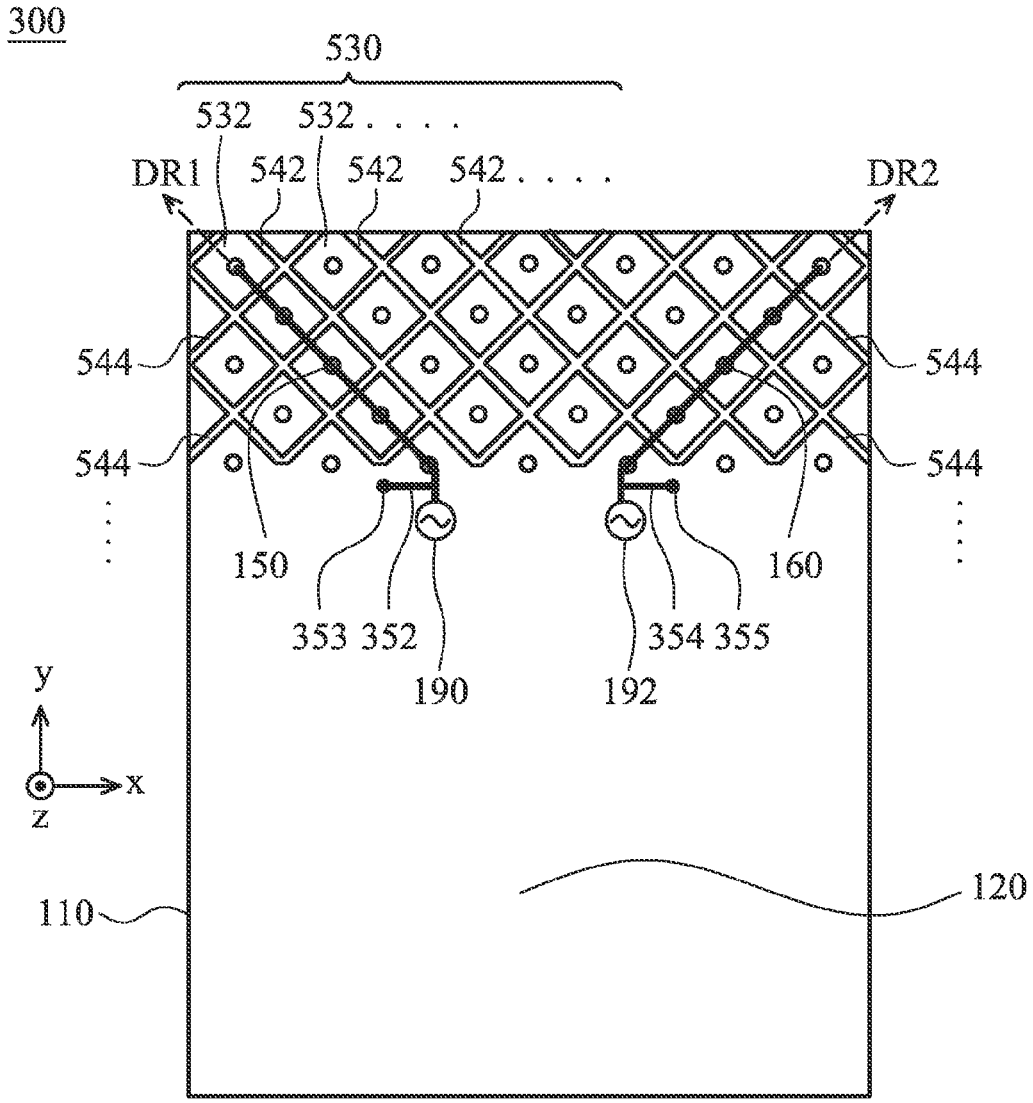
FIG. 3 is a top-view diagram for illustrating a MIMO antenna according to a second embodiment of the invention.

FIG. 3 is a top-view diagram for illustrating a MIMO antenna 300 according to a second embodiment of the invention. The MIMO antenna 300 in the second embodiment is similar to the MIMO antenna 100 in the first embodiment. The main difference between them is that an EBG structure 530 of the MIMO antenna 300 is tilted by 45 degrees. That is, a plurality of EBG cells 532 and a plurality of partition gaps 542 and 544 therebetween (in different directions) are all tilted by 45 degrees in comparison to those in FIG. 1A. Another difference is that two matching stubs 352 and 354 of the MIMO antenna 300 extend away from each other. The matching stubs 352 and 354 may be electrically coupled through shorting vias 353 and 355 down to the antenna ground plane 120, respectively. In the second embodiment, some partition gaps 542 are substantially parallel to the first direction DR1 in which the first antenna element 150 extends, and the other partition gaps 544 are substantially parallel to the second direction DR2 in which the second antenna element 160 extends. After being tilted, the EBG structure 530 extends in the same directions as the first antenna element 150 and the second antenna element 160, thereby improving the isolation between the first antenna element 150 and the second antenna element 160.

Figure 4:
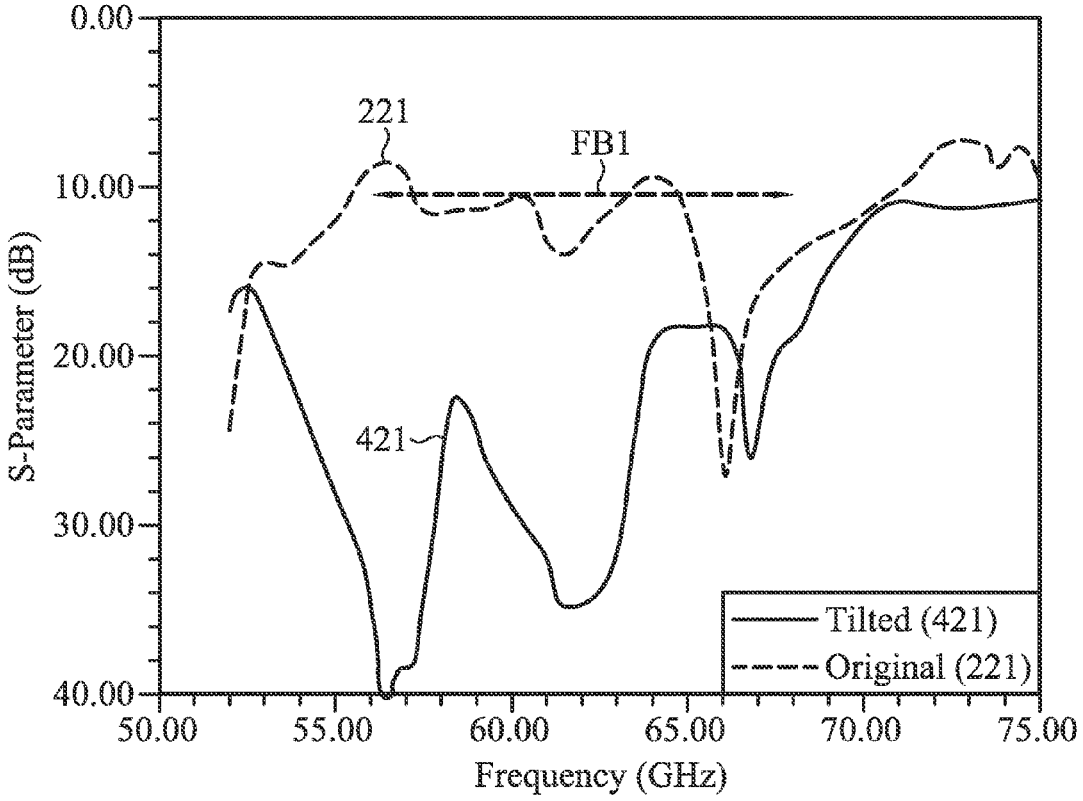
FIG. 4 is a diagram for illustrating S parameters of a MIMO antenna according to the second embodiment of the invention.

FIG. 4 is a diagram for illustrating S parameters of the MIMO antenna 300 according to the second embodiment of the invention. The horizontal axis represents S parameters (dB), and the horizontal axis represents operation frequency (GHz). In comparison, the isolation (S21) curve 421 of the MIMO antenna 300 with the tilted EBG structure 530 is much lower than the isolation (S21) curve 221 of the MIMO antenna 100 with the original EBG structure 130. The isolation (S21) curve 421 of the MIMO antenna 300 is lower than −18 dB in the band FB1. In other words, the tilted EBG structure 530 can improve the isolation between the first antenna element 150 and the second antenna element 160 by at least 8 dB.

Figure 5A:
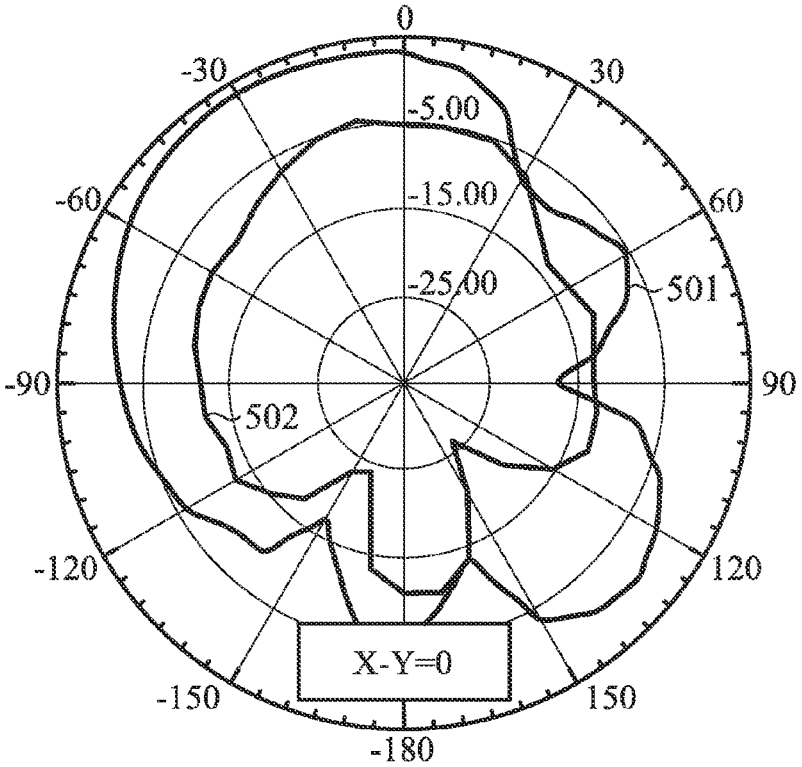
FIG. 5A is a diagram for illustrating co-polarization and cross-polarization of a MIMO antenna in a direction according to the second embodiment of the invention.
Figure 5B:
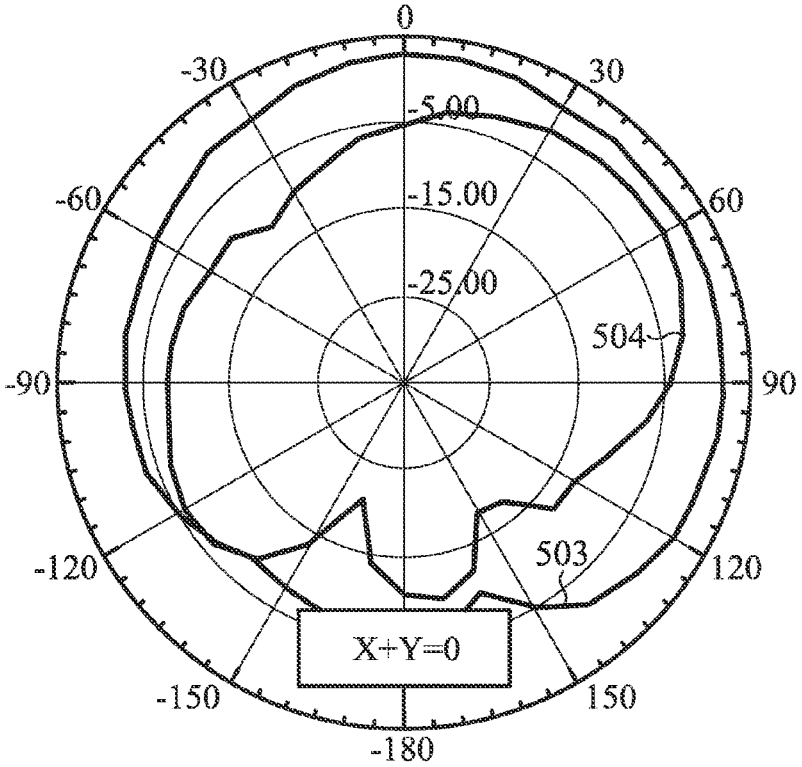
FIG. 5B is a diagram for illustrating co-polarization and cross-polarization of a MIMO antenna in another direction according to the second embodiment of the invention.

FIG. 5A is a diagram for illustrating co-polarization and cross-polarization of the MIMO antenna 300 in the second direction DR2 according to the second embodiment of the invention. As shown in FIG. 5A, the co-polarization curve 501 represents the co-polarization fields, and the cross-polarization curve 502 represents the cross-polarization fields, wherein the foregoing polarizations are measured along the second direction DR2 parallel to the straight line x−y=0 on the XY-plane. FIG. 5B is a diagram for illustrating co-polarization and cross-polarization of the MIMO antenna 300 in the first direction DR1 according to the second embodiment of the invention. As shown in FIG. 5B, the co-polarization curve 503 represents the co-polarization fields, and the cross-polarization curve 504 represents the cross-polarization fields, wherein the foregoing polarizations are measured along the first direction DR1 parallel to the straight line x+y=0 on the XY-plane. According to FIGS. 5A and 5B, the polarized isolation (co-polarization/cross-polarization) of the MIMO antenna 300 in the second embodiment is about 8 dB.

Figure 6A:
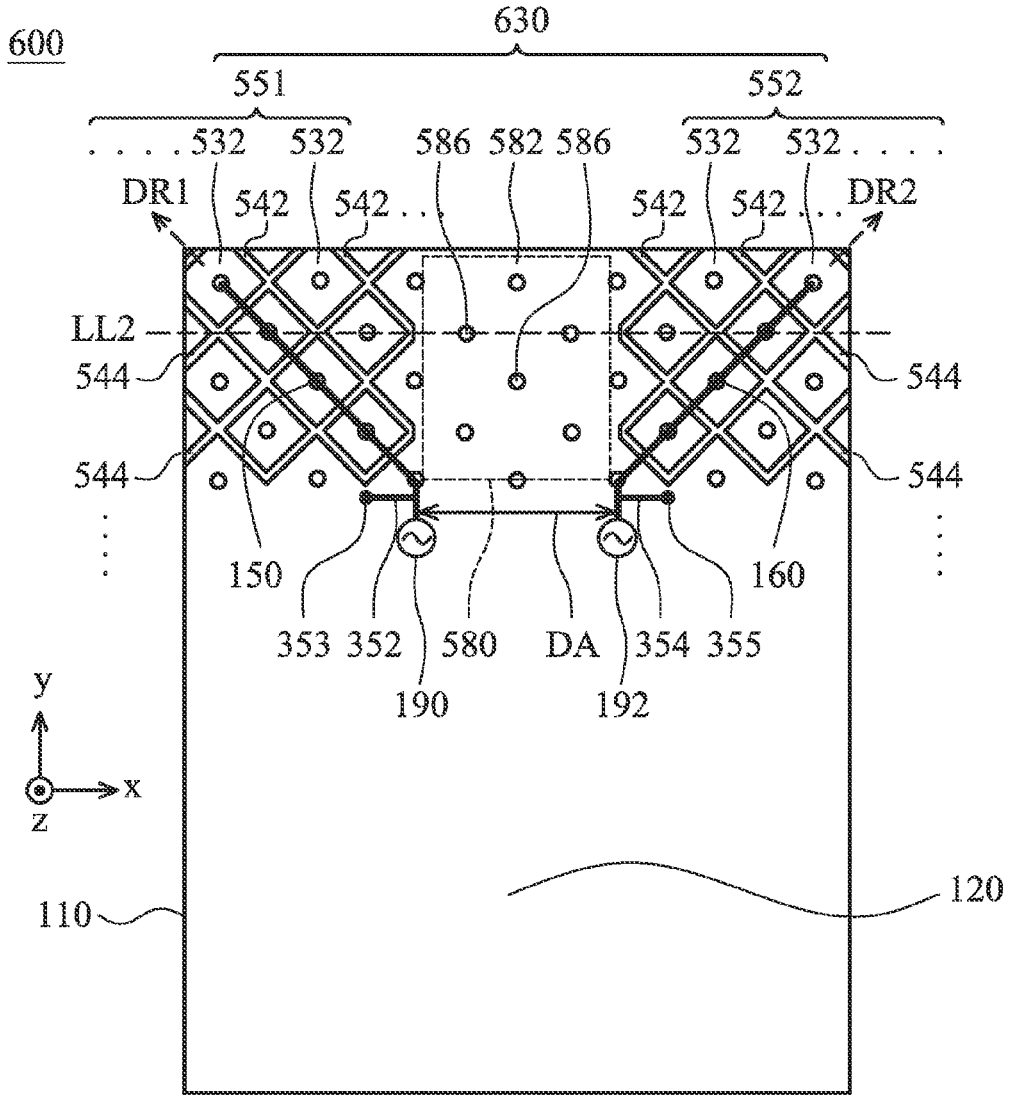
FIG. 6A is a top-view diagram for illustrating a MIMO antenna according to a third embodiment of the invention.
Figure 6B:
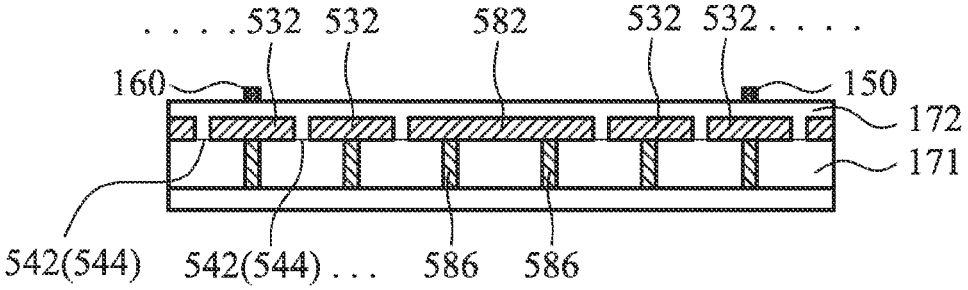
FIG. 6B is a cross-section diagram for illustrating a MIMO antenna along a straight line according to the third embodiment of the invention.

FIG. 6A is a top-view diagram for illustrating a MIMO antenna 600 according to a third embodiment of the invention. FIG. 6B is a cross-section diagram for illustrating the MIMO antenna 600 along a dashed line LL2 according to the third embodiment of the invention. The MIMO antenna 600 in the third embodiment is similar to the MIMO antenna 300 in the second embodiment. The main difference between them is that an EBG structure 630 of the MIMO antenna 600 comprises a first EBG portion 551 and a second EBG portion 552, and the MIMO antenna 600 further comprises a grounding structure 580. Similarly, each of the first EBG portion 551 and the second EBG portion 552 comprises a plurality of tilted EBG cells 532, which are separated by a plurality of tilted partition gaps 542 and 544. In the third embodiment, the grounding structure 580 is electrically coupled to the system ground plane 110, and the grounding structure 580 substantially separates the first EBG portion 551 from the second EBG portion 552. The grounding structure 580 is substantially positioned between the first antenna element 150 and the second antenna element 160. The first antenna element 150 is in proximity to the first EBG portion 551, and the second antenna element 160 is in proximity to the second EBG portion 552. The width of the grounding structure 580 is approximately equal to the distance DA between the signal sources 190 and 192. Referring to FIG. 6B, in some embodiments, the grounding structure 580 merely comprises a mid ground plane 582 without any partition gap. In a preferred embodiment, the grounding structure 580 further comprises a plurality of grounding vias 586, and the mid ground plane 582 is electrically coupled through the grounding vias 586 down to the system ground plane 110. With the grounding structure 580, the MIMO antenna 600 has more symmetrical structures than the MIMO antenna 300 does. Note that each of the first EBG portion 551 and the second EBG portion 552 has two edges surrounded by the antenna ground plane 120 and the grounding structure 580. Due to the symmetrical ground planes, the polarized isolation of the MIMO antenna 600 is enhanced significantly.

Figure 7A:
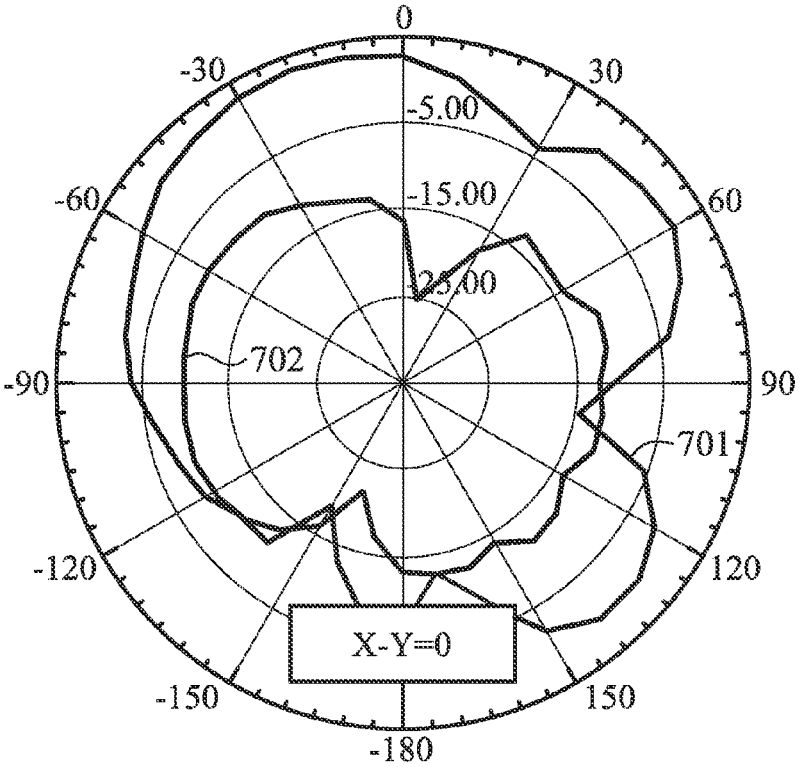
FIG. 7A is a diagram for illustrating co-polarization and cross-polarization of a MIMO antenna in a direction according to the third embodiment of the invention.
Figure 7B:
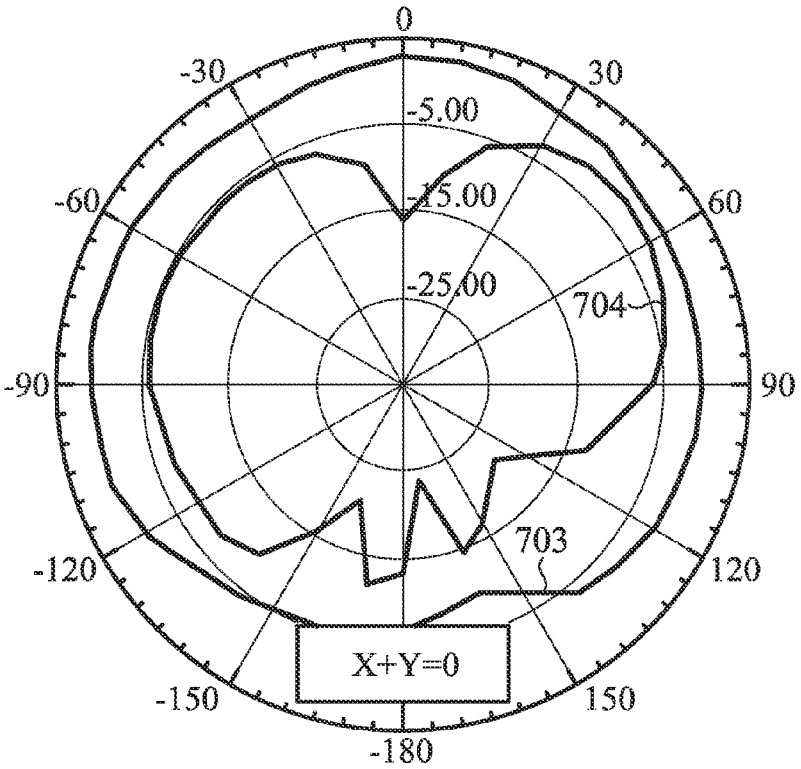
FIG. 7B is a diagram for illustrating co-polarization and cross-polarization of a MIMO antenna in another direction according to the third embodiment of the invention.

FIG. 7A is a diagram for illustrating co-polarization and cross-polarization of the MIMO antenna 600 in the second direction DR2 according to the third embodiment of the invention. As shown in FIG. 7A, the co-polarization curve 701 represents the co-polarization fields, and the cross-polarization curve 702 represents the cross-polarization fields, wherein the foregoing polarizations are measured along the second direction DR2 parallel to the straight line x-y=0 on the XY-plane. FIG. 7B is a diagram for illustrating co-polarization and cross-polarization of the MIMO antenna 600 in the first direction DR1 according to the third embodiment of the invention. As shown in FIG. 7B, the co-polarization curve 703 represents the co-polarization fields, and the cross-polarization curve 704 represents the cross-polarization fields, wherein the foregoing polarizations are measured along the first direction DR1 parallel to the straight line x+y=0 on the XY-plane. According to FIGS. 7A and 7B, the polarized isolation of the MIMO antenna 600 in the third embodiment is about 18 dB, which is much better than that in the second embodiment.

Figure 8:
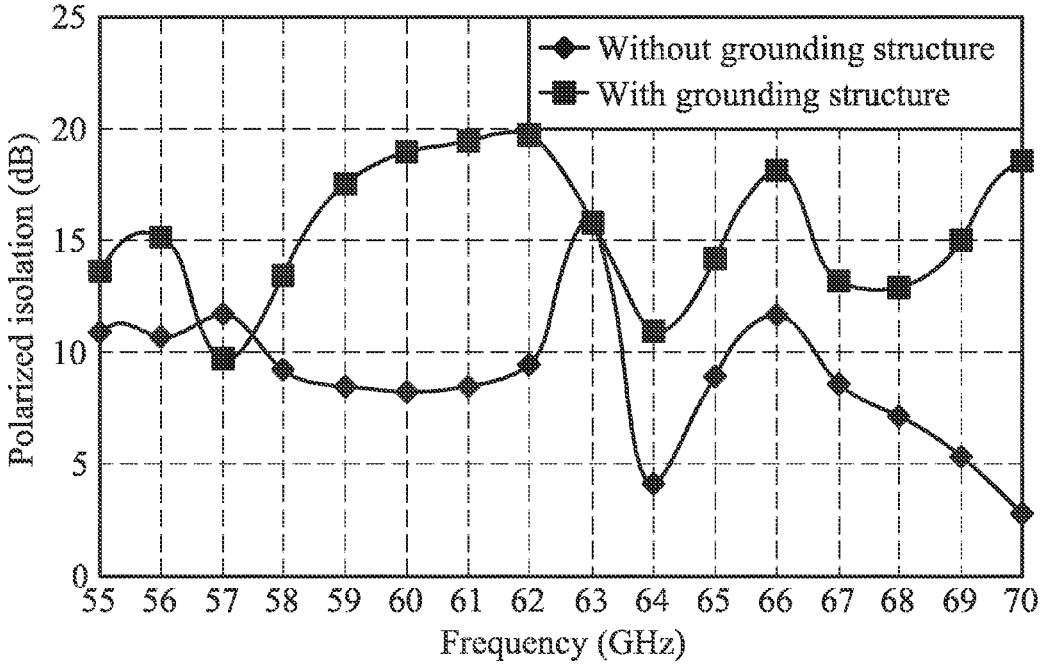
FIG. 8 is a diagram for illustrating polarized isolation of a MIMO antenna with and without a grounding structure.

FIG. 8 is a diagram for illustrating the polarized isolation of the MIMO antenna with and without the grounding structure 580. The horizontal axis represents the polarized isolation (dB), and the horizontal axis represents operation frequency (GHz). As shown in FIG. 8, from 57 GHz to 66 GHz, the polarized isolation of the MIMO antenna 600 with the grounding structure 580 is much higher than that of the MIMO antenna 300 without the grounding structure 580. Accordingly, the grounding structure 580 is incorporated so as to effectively increase the isolation between the first antenna element 150 and the second antenna element 160.

Figure 9:
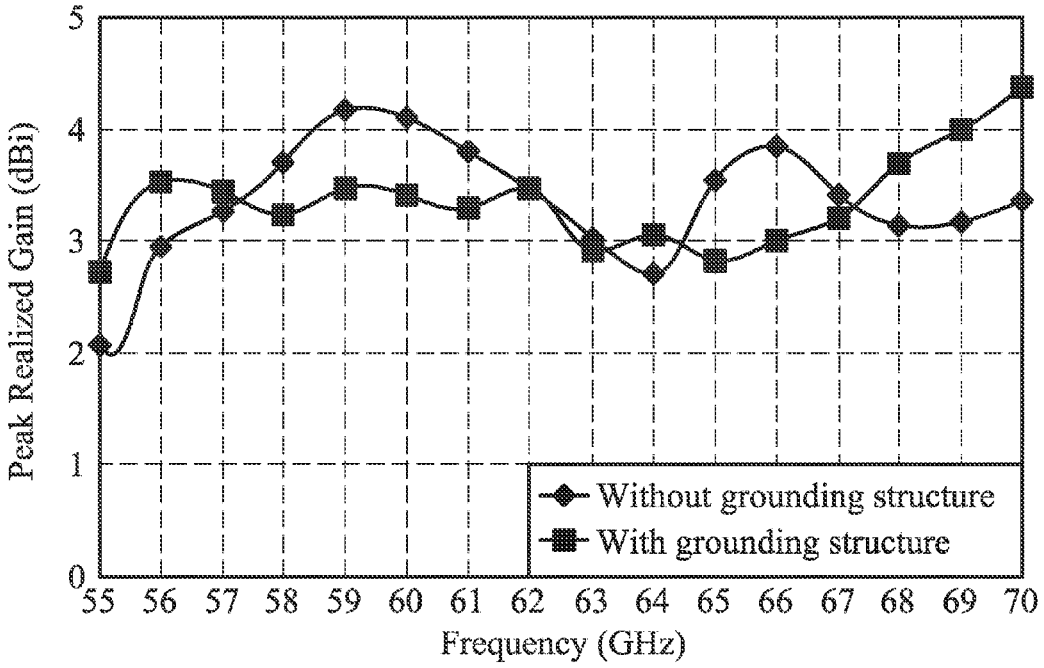
FIG. 9 is a diagram for illustrating peak realized gain of a MIMO antenna with and without a grounding structure.

FIG. 9 is a diagram for illustrating peak realized gain of the MIMO antenna with and without the grounding structure 580. The horizontal axis represents peak realized gain (dBi), and the horizontal axis represents operation frequency (GHz). As shown in FIG. 9, from 57 GHz to 66 GHz, the peak realized gain of the MIMO antenna 600 with the grounding structure 580 is more stable than that of the MIMO antenna 300 without the grounding structure 580. Accordingly, the grounding structure 580 is incorporated so as to effectively reduce fluctuation of the peak realized gain of the MIMO antenna 600.

Each MIMO antenna with an EBG structure in the invention is designed to provide good antenna efficiency and high isolation between multiple antenna elements. Theoretically, these MIMO antennas may operate in a 60 GHz band to support high-speed data transmission. The invention is low-cost and can be used in many applications, such as a CP (Circular Polarization) antenna, a MMW (Millimeter Wave) antenna, and a diversity antenna array.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A MIMO (Multi-Input Multi-Output) antenna, comprising:

a system ground plane;

an antenna ground plane, overlapping a first portion of the system ground plane;

an EBG (Electromagnetic Band-Gap) structure, formed on a second portion of the system ground plane;

a first antenna element, partly overlapping the EBG structure, and substantially extending in a first direction; and a second antenna element, partly overlapping the EBG structure, and substantially extending in a second direction different from the first direction, wherein a distance between the first antenna element and the second antenna element is smaller than 0.5 wavelength of a central operation frequency at which the first antenna element and the second antenna element operate.

2. The MIMO antenna as claimed in claim 1, wherein the first direction is substantially perpendicular to the second direction.

3. The MIMO antenna as claimed in claim 1, further comprising:

a first dielectric material, formed on the system ground plane, wherein the antenna ground plane is disposed on the first dielectric material, and the EBG structure is formed in the first dielectric material.

4. The MIMO antenna as claimed in claim 3, wherein a height of the first dielectric material is smaller than 0.1 wavelength of a central operation frequency at which the first antenna element and the second antenna element operate.

5. The MIMO antenna as claimed in claim 1, further comprising:

a second dielectric material, formed on the EBG structure and the antenna ground plane, wherein the first antenna element and the second antenna element are disposed on the second dielectric material.

6. The MIMO antenna as claimed in claim 5, wherein a height of the second dielectric material is smaller than 0.1 wavelength of a central operation frequency at which the first antenna element and the second antenna element operate.

7. The MIMO antenna as claimed in claim 1, wherein the EBG structure comprises a plurality of EBG cells, and each of the EBG cells substantially has a mushroom shape.

8. The MIMO antenna as claimed in claim 7, wherein each of the EBG cells comprises a patch and a cell via, and the patch is coupled through the cell via to the system ground plane.

9. The MIMO antenna as claimed in claim 7, wherein the EBG cells are separated by a plurality of partition gaps.

10. The MIMO antenna as claimed in claim 9, wherein some of the partition gaps are substantially parallel to the first direction, and the other partition gaps are substantially parallel to the second direction.

11. The MIMO antenna as claimed in claim 1, wherein the EBG structure comprises a first EBG portion and a second EBG portion, and the MIMO antenna further comprises:

a grounding structure, coupled to the system ground plane, and substantially separating the first EBG portion from the second EBG portion.

12. The MIMO antenna as claimed in claim 11, wherein the grounding structure comprises a mid ground plane without any partition gap and a plurality of grounding vias, and the mid ground plane is coupled through the grounding vias to the system ground plane.

13. The MIMO antenna as claimed in claim 11, wherein the grounding structure is substantially positioned between the first antenna element and the second antenna element, and the first antenna element is in proximity to the first EBG portion, and the second antenna element is in proximity to the second EBG portion.

14. The MIMO antenna as claimed in claim 1, wherein the first antenna element and the second antenna element are monopole antennas.

15. The MIMO antenna as claimed in claim 1, wherein each of the first antenna element and the second antenna element further comprises a matching stub.

16. The MIMO antenna as claimed in claim 15, wherein an end of the matching stub is coupled through a shorting via to the antenna ground plane.

17. The MIMO antenna as claimed in claim 1, wherein the first antenna element and the second antenna element cover a band substantially from 57 GHz to 66 GHz.

18. The MIMO antenna as claimed in claim 1, wherein the EBG structure provides a reflection phase difference substantially from 45 degrees to 135 degrees.

19. The MIMO antenna as claimed in claim 1, wherein a total height of the MIMO antenna is smaller than 0.125 wavelength of a central operation frequency at which the first antenna element and the second antenna element operate.

* * * * *